US007513386B2

(12) United States Patent
Hartjes et al.

(10) Patent No.: US 7,513,386 B2
(45) Date of Patent: Apr. 7, 2009

(54) CONTAINER EMPLOYING AN INNER LINER FOR THERMAL INSULATION

(75) Inventors: Timothy P. Hartjes, Kimberly, WI (US); Michael A. Breining, Neenah, WI (US); Gerald J. Van Handel, Neenah, WI (US); David C. Brown, Clark Summit, PA (US); Walter Malakhow, Phillipsburg, NJ (US)

(73) Assignee: Dixie Consumer Products LLC, Atlanta, GA (US)

( * ) Notice: Subject to any disclaimer, the term of this patent is extended or adjusted under 35 U.S.C. 154(b) by 288 days.

(21) Appl. No.: 11/174,434

(22) Filed: Jun. 30, 2005

(65) Prior Publication Data

US 2007/0000931 A1 Jan. 4, 2007

(51) Int. Cl.
*B65D 81/38* (2006.01)

(52) U.S. Cl. ..... 220/592.2

(58) Field of Classification Search ..... 220/495.05, 220/495.04, 495.01, 677, 676, 745, 592.17, 220/592.16, 62.18, 506; 229/403; 383/110, 383/112, 118

See application file for complete search history.

(56) References Cited

U.S. PATENT DOCUMENTS

| | | | | | |
|---|---|---|---|---|---|
| 593,316 | A | * | 11/1897 | Woodman | 220/573.4 |
| 1,157,008 | A | * | 10/1915 | Lang | 220/6 |
| 1,407,688 | A | * | 2/1922 | Banton | 220/676 |
| 1,756,243 | A | | 4/1930 | Benson | |
| 1,944,042 | A | | 1/1934 | Thompson | |
| 2,266,828 | A | * | 12/1941 | Sykes | 220/1.5 |
| 2,563,352 | A | * | 8/1951 | Morse | 206/515 |
| 2,678,764 | A | * | 5/1954 | Carlson | 141/390 |
| 2,853,222 | A | | 9/1958 | Gallagher | 229/403 |
| 2,961,849 | A | | 11/1960 | Hitchcock | |
| 3,082,900 | A | | 3/1963 | Goodman | 229/403 |
| 3,134,307 | A | | 5/1964 | Loeser | |
| 3,203,611 | A | * | 8/1965 | Anderson et al. | 229/403 |
| 3,237,834 | A | | 3/1966 | Davis et al. | 229/400 |
| 3,246,745 | A | | 4/1966 | Stoker, Jr. | 206/419 |

(Continued)

FOREIGN PATENT DOCUMENTS

JP 57-065158 A 4/1982

(Continued)

OTHER PUBLICATIONS

Williams, M.B. et al. "Investigation of Spatial Resolution and Efficiency Using Pinholes with Small Pinhole Angle". Nuclear Science Symposium Conference Record, 2002 IEEE. Nov. 10-16, 2002, p. 1760-1764 vol. 3.

(Continued)

*Primary Examiner*—Anthony D Stashick
*Assistant Examiner*—Robert J Hicks
(74) *Attorney, Agent, or Firm*—Michael W. Ferrell

(57) ABSTRACT

A container comprising a sidewall and an inner liner. The inner liner includes an intermediate portion affixed to the sidewall about a periphery of the intermediate portion. The sidewall includes a vent disposed within the periphery of the intermediate portion. The intermediate portion is adapted to separate from the sidewall such that ambient air flows through the vent to form an air pocket between the intermediate portion of the inner liner and the sidewall.

22 Claims, 3 Drawing Sheets

U.S. PATENT DOCUMENTS

| | | | | |
|---|---|---|---|---|
| 3,402,874 | A | 9/1968 | Sternall | 229/125.05 |
| 3,406,814 | A | 10/1968 | Gulliver | 206/497 |
| 3,627,166 | A | 12/1971 | Walter | 220/62.2 |
| 3,737,093 | A | 6/1973 | Amberg et al. | |
| 3,781,183 | A | 12/1973 | Doll | 229/400 |
| 3,854,583 | A | 12/1974 | Amberg et al. | |
| 3,988,521 | A | 10/1976 | Fumel et al. | |
| 3,995,740 | A | 12/1976 | Amberg et al. | |
| 4,051,951 | A | 10/1977 | Smith | |
| 4,087,003 | A | 5/1978 | Adamek | 206/497 |
| 4,261,501 | A | 4/1981 | Watkins et al. | 229/404 |
| 4,383,422 | A | 5/1983 | Gordon et al. | |
| 4,398,904 | A | 8/1983 | Fagerberg | |
| 4,435,344 | A | 3/1984 | Ioka | |
| 4,452,596 | A | 6/1984 | Clauss et al. | |
| 4,486,366 | A | 12/1984 | Reddy | |
| 4,514,354 | A | 4/1985 | Schlesinger et al. | |
| 4,679,724 | A | 7/1987 | Inagaki | |
| 4,692,132 | A | 9/1987 | Ikushima et al. | |
| 4,923,557 | A | 5/1990 | Dickey | |
| 4,971,845 | A | 11/1990 | Aaker et al. | 428/34.9 |
| 4,982,872 | A | 1/1991 | Avery | 220/62.13 |
| 4,985,300 | A | 1/1991 | Huang | 428/332 |
| 5,001,016 | A | 3/1991 | Kondo et al. | |
| 5,092,485 | A | 3/1992 | Lee | 229/403 |
| 5,145,107 | A | 9/1992 | Silver et al. | |
| 5,205,473 | A | 4/1993 | Coffin, Sr. | 493/907 |
| 5,217,307 | A | 6/1993 | McClintock | 229/123.2 |
| 5,469,983 | A | 11/1995 | Yawata | |
| 5,490,631 | A | 2/1996 | Iioka et al. | |
| 5,700,689 | A * | 12/1997 | Wuster | 435/290.1 |
| 5,725,916 | A | 3/1998 | Ishii et al. | |
| 5,736,231 | A | 4/1998 | Todt | 428/34.9 |
| 5,766,709 | A | 6/1998 | Geddes et al. | |
| 5,840,139 | A | 11/1998 | Geddes et al. | |
| 5,882,612 | A * | 3/1999 | Riley | 422/300 |
| 5,952,068 | A | 9/1999 | Neale et al. | |
| 5,954,217 | A | 9/1999 | Brkovic et al. | |
| 5,993,705 | A | 11/1999 | Grischenko et al. | |
| 6,030,476 | A | 2/2000 | Geddes et al. | |
| 6,098,829 | A | 8/2000 | McHenry et al. | |
| 6,129,653 | A | 10/2000 | Fredericks et al. | |
| 6,139,665 | A | 10/2000 | Schmelzer et al. | |
| 6,142,331 | A | 11/2000 | Breining et al. | |
| 6,224,954 | B1 | 5/2001 | Mitchell et al. | |
| 6,364,149 | B1 * | 4/2002 | Smith | 220/592.2 |
| 6,536,657 | B2 | 3/2003 | Van Handel | 229/403 |
| 6,729,534 | B2 | 5/2004 | Van Handel | 229/403 |
| 6,852,381 | B2 | 2/2005 | Debraal et al. | |
| 7,281,650 | B1 * | 10/2007 | Milan | 229/403 |
| 2003/0015582 | A1 * | 1/2003 | Handel | 229/403 |
| 2003/0021921 | A1 | 1/2003 | Debraal et al. | 428/34.2 |
| 2003/0121963 | A1 * | 7/2003 | Van Handel | 229/403 |
| 2004/0170814 | A1 | 9/2004 | Van Handel | |
| 2005/0029337 | A1 | 2/2005 | Van Handel | |
| 2005/0184074 | A1 * | 8/2005 | Simmons et al. | 220/592.17 |
| 2007/0029332 | A1 | 2/2007 | Hartjes et al. | |
| 2007/0114271 | A1 | 5/2007 | Van Handel | |

FOREIGN PATENT DOCUMENTS

| | | | |
|---|---|---|---|
| JP | 06-219474 | A | 8/1994 |
| JP | 06219474 | A | 8/1994 |
| JP | 2000-177785 | | 6/2000 |

OTHER PUBLICATIONS

International Search Report for PCT/US2006/025916 having a mail date of Mar. 11, 2006.

Unpublished U. S. Appl. No. 11/956,853, filed Dec. 14, 2007, entitled Blank for Disposable Thermally Insulated Container.

* cited by examiner

CONTAINER EMPLOYING AN INNER LINER FOR THERMAL INSULATION

BACKGROUND OF THE INVENTION

1. Field of the Invention

The field of the present invention is containers including thermal insulation for holding hot liquids.

2. Background

U.S. Pat. Nos. 6,536,657 and 6,729,534, both to Van Handel, disclose a shrink film secured to the interior of the container. The shrink film is adapted to shrink when a hot liquid is placed into the container, thereby forming an insulating void between the shrink film and the wall of the container. U.S. Patent Publication No. 2005-0029337 in the name of Van Handel describes further improvement on the container using shrink film to form the insulating void.

Other configurations for thermally insulated cups are also known. For example, the insulated cup disclosed in U.S. Pat. No. 3,737,093 to Amberg et al. uses a plastic cup placed within a paper cup to create an air space for thermal insulation. Another insulated cup is disclosed in U.S. Pat. No. 4,435,344 to Iioka. This cup is formed of a paper cup coated with a thermoplastic synthetic resin film which is subsequently heated to form a foam insulating layer. U.S. Pat. No. 5,952,068 to Neale et al. discloses a cup insulation layer formed from syntactic foam, a type of foam which incorporates insulating particles, which may contain an air space, held in place by a binder.

The disclosure of each of the above-mentioned documents are incorporated herein by reference.

SUMMARY OF THE INVENTION

The present invention is directed toward a container employing an inner liner for thermal insulation. The inner liner includes an intermediate portion which is peripherally affixed to the sidewall of the container. A vent is disposed in the sidewall within the periphery of the intermediate portion. The intermediate portion of the inner liner is adapted to separate from the sidewall, and upon separation, ambient air flows through the vent to form an air pocket between the sidewall and the intermediate portion of the inner liner.

Accordingly, an improved container employing an inner liner for thermal insulation is provided. Other objects and advantages will appear hereinafter.

BRIEF DESCRIPTION OF THE DRAWINGS

In the drawings, wherein like reference numerals refer to similar components.

DETAILED DESCRIPTION OF THE PREFERRED EMBODIMENTS

Figure 1:
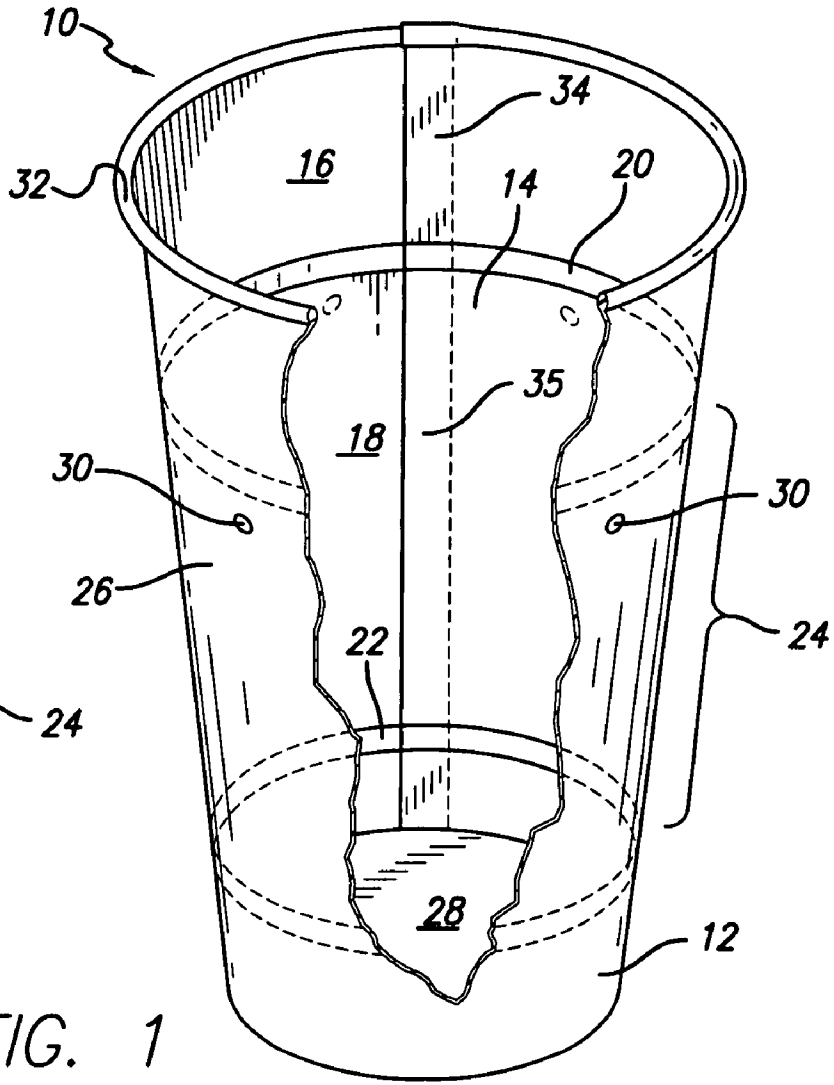
FIG. 1 is a partially cut away front perspective view of a cup employing shrink film for thermal insulation.

Turning in detail to the drawings, FIG. 1 illustrates a partially cut away front perspective view of an insulated cup 10. An otherwise conventional paperboard cup 12 has a shrink film 14 affixed to the inner surface 16 of the cup 12 to form an inner liner for the insulated cup 10. The intermediate portion 18 of the shrink film 14, which is that portion between the upper and lower circumferential bands 20, 22, defines the comfort band 24 of the insulated cup 10. The paperboard cup 12 has a relatively rigid sidewall 26 and bottom 28 which are formed from a polyethylene ("PE") coated paperboard stock. Other appropriate material, including uncoated paperboard, may be substituted for the coated paperboard stock. The sidewall 26 includes at least one vent 30 disposed within the comfort band 24 of the cup 10. Preferably, the vent 30 is disposed closer to the brim 32 of the sidewall 26 to minimize leakage in the event the shrink film 14 becomes perforated or otherwise separates from the sidewall 26. The vertical seam 34 of the paperboard cup 12 connects the two side edges (48*a* and 48*b* of FIG. 3) of the generally annular sector shaped blank from which the sidewall 26 is formed. This vertical seam 34 is partially integrated with the vertical seam 35 of the shrink film 14, although full integration is possible if the shrink film has dimensions similar to that of the paperboard blank prior to cup formation. Other forming processes, such as those described in U.S. Pat. Nos. 6,536,657 and 6,729,534, may also be employed. The cup 10 is tapered to facilitate stacking, and the sidewall 26 extends below the bottom 28 to form a bottom space 36 (see FIG. 2) between the bottom 28 and the table or other support surface (not shown) upon which the cup 10 may be placed.

Figure 2:
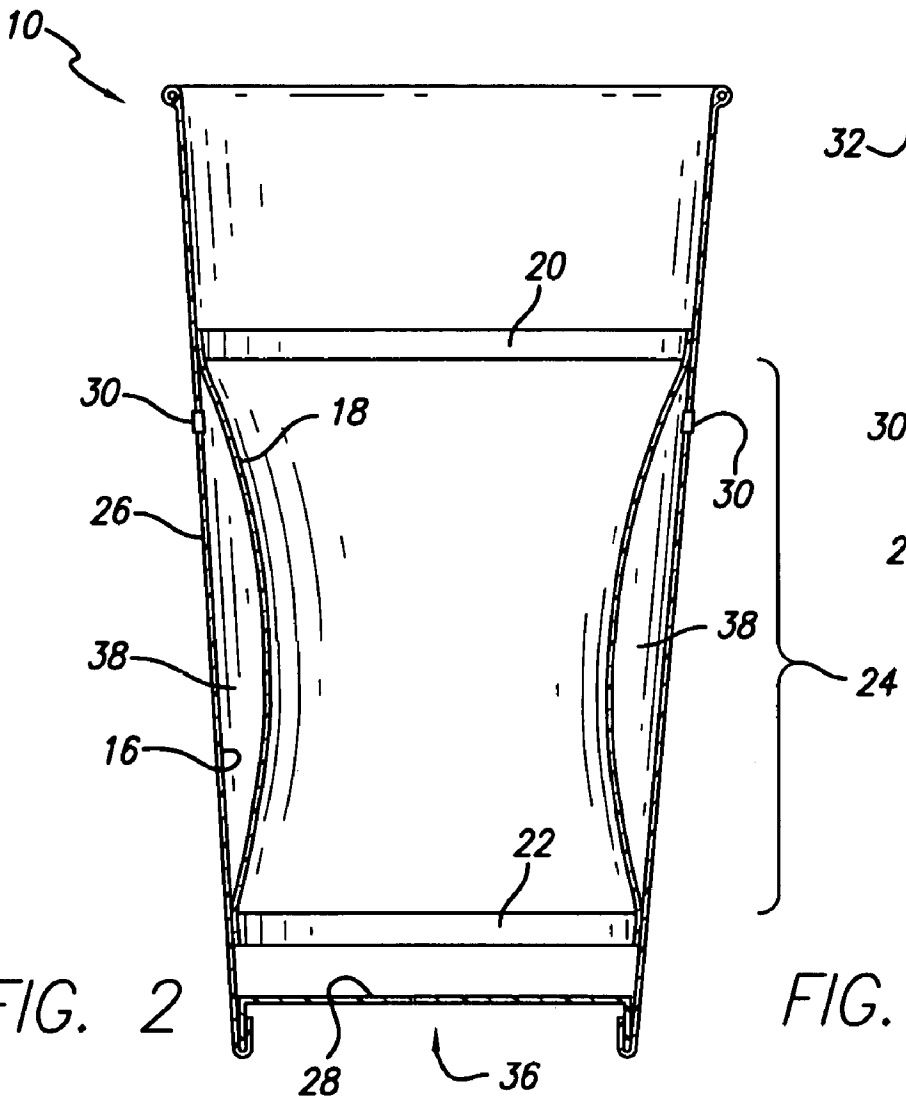
FIG. 2 is a vertical cross section of the cup of FIG. 1.

Referring to FIG. 2, the intermediate portion 18 of the shrink film 14 is separable, either wholly or partially, from the inner surface 16 of the sidewall 26. Upon separation, an air pocket 38 is formed in the space between the intermediate portion 18 of the shrink film 14 and the inner surface 16 of the sidewall 26. This air pocket 38 substantially encircles the entire circumference of the cup 10 and is filled with ambient air passing through the vents 30 in the sidewall 26 as the separation occurs. Where the shrink film 14 is affixed to the paperboard cup 12 before cup formation, the air pocket 38 generally will not extend through the vertical seam 34 of the paperboard cup 12. However, by affixing the shrink film to the paperboard cup 12 after cup formation, the air pocket 38 may be formed about the entire circumference of the cup 10. Separation of the shrink film 14 from the paperboard cup 12 is initiated by application of heat to the shrink film 14, such heat generally being provided when hot liquid is poured into the cup 10. The resulting air pocket 38 serves to insulate comfort band 24 portion of the cup 10 from the hot liquid within the cup 10.

The shrink film 14 may be a heat shrinkable material such as Bemis Clysar EZT 60 or 75 gauge shrink film and may be affixed to the sidewall 26 using a laminating adhesive such as Henkel 6B-5458M, which is sufficient to resist film shrinkage in the adhered areas of the shrink film 14 while the cup 10 is in use. Further, the shrink film 14 may be adhered to the paperboard cup 12 in any of a wide variety of patterns and need not be constrained to a circumferential band about the cup 10. For example, the shrink film may be adhered to the paperboard in any one of the patterns described in U.S. Pat. Nos. 6,536,657 and 6,729,534.

The extent to which the shrink film 14 shrinks away from the sidewall 26 and into the interior of the cup 10 will vary, depending upon the maximum temperature of the liquid, and may range from about 0.125 inches for warm (150° F.) to about 0.50 inches for almost boiling (212° F.) liquids. The cup 10 is constructed to provide optimal insulation for liquid having a temperature in the range of 150-190° F., although the cup 10 will provide adequate insulation for a liquid having a temperature in the range of 140-212° F., or even 32-212° F.

Figure 3:
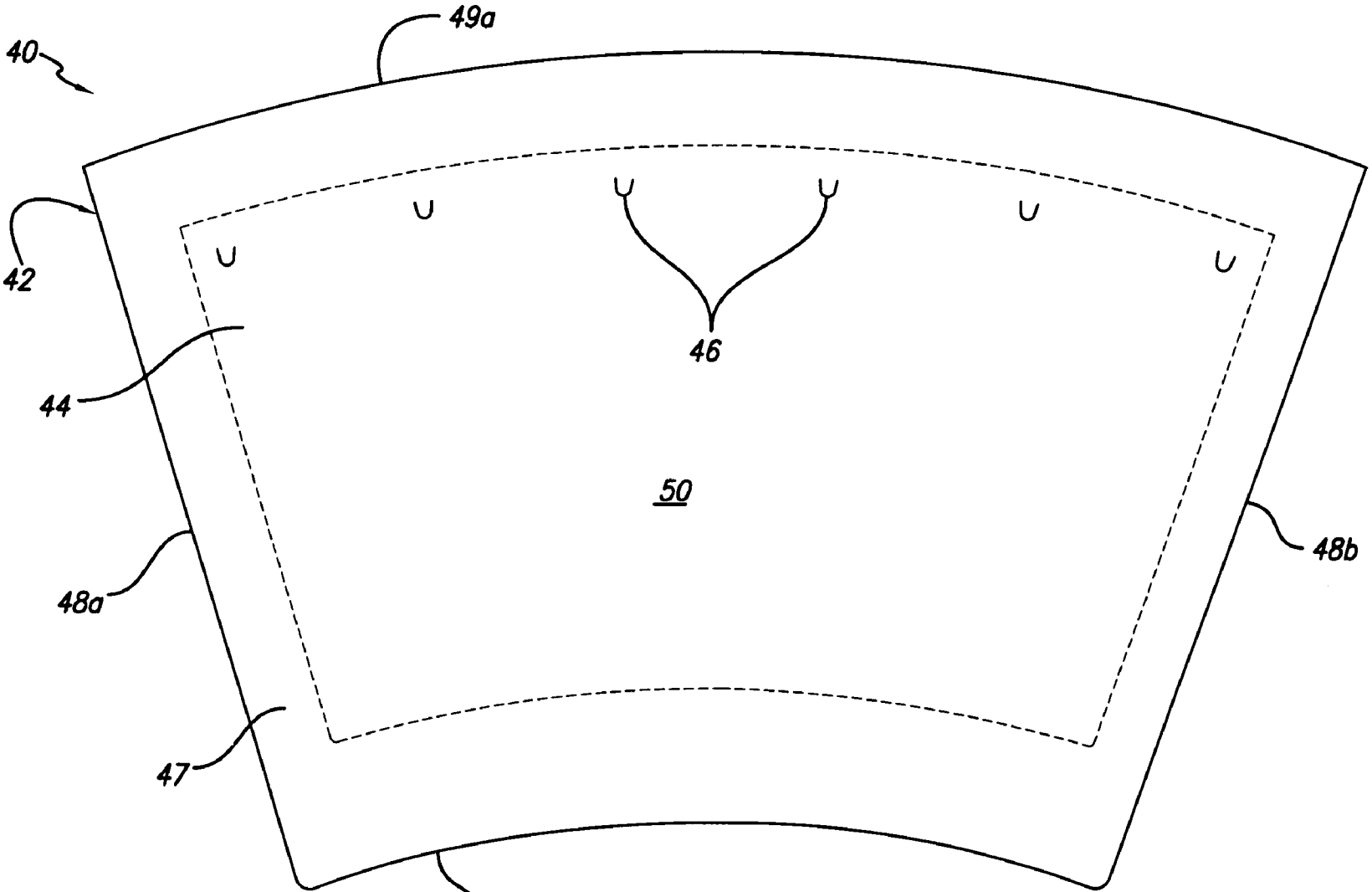
FIG. 3 is a layout of a blank for an insulated cup.
Figure 4:
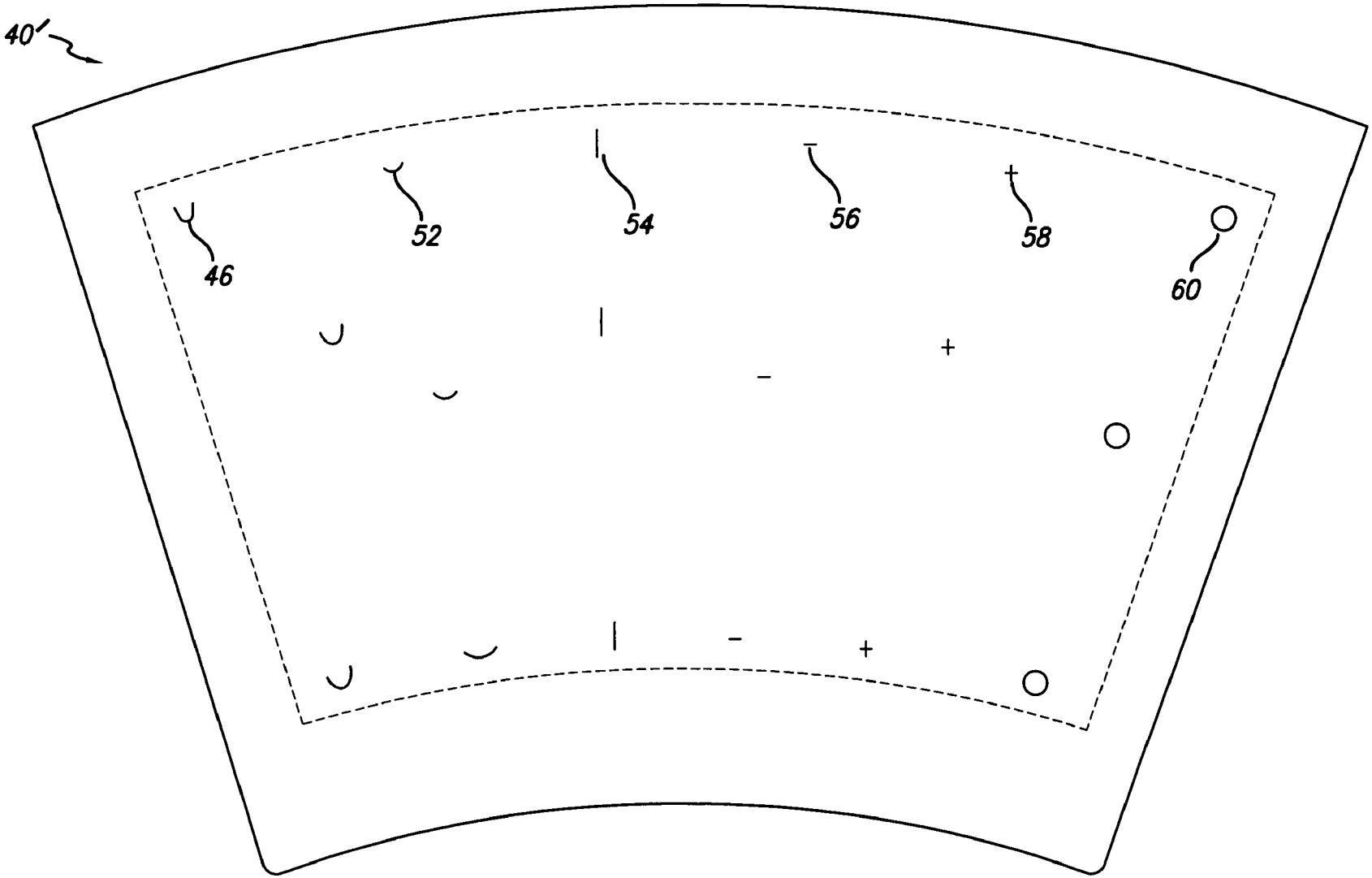
FIG. 4 is a layout of a blank for a cup showing different alternatives for the shape of the vents.

FIG. 3 illustrates a cup blank 40 for use in one method of manufacturing an insulated cup. The cup blank 40 includes a paperboard blank 42 onto which a sheet of similarly sized shrink film 44 is laminated. The shrink film 44 may be laminated to the paperboard blank 42 before or after the blank is cut. U-shaped vents 46 are cut into the paperboard blank 42 prior to lamination of the shrink film 44 onto the paperboard blank 42. Alternative shapes and locations for vents are depicted on the cup blank 40' of FIG. 4. The vents may be large flaps 46, small flaps 52, slits 54, perforations 56, x-shaped cut-outs 58, round holes 60, or any other shape. The vents may also vary in number, size, and location and need not be all the same size, all the same shape, or uniformly dispersed. The form, number, and location of the vents are wholly a matter of design choice, with the primary considerations being that (1) shrinkage of the shrink film should not be unduly hindered by slow pressure equalization between the ambient air and the forming air pocket and (2) leakage from the vents, in the event the shrink film is perforated or detaches from the sidewall, is preferably minimized by locating the vents near the cup brim.

Returning to FIG. 3, the laminating adhesive is flexo printed onto the blank 42 in the peripheral laminating area 47, although other printing processes may be employed, such as gravure printing or the like. The adhesive is printed in register with the paperboard blank 42 and the cup print design, if any design is used. Only the periphery of the shrink film 44 is adhered to the paperboard blank 42; the interior portion 50 of the shrink film 44 is left unadhered to advantageously form the comfort band during use. Once the shrink film 44 is adhered to the paperboard blank 42, the resulting cup blank 40 may be used to form an insulated cup. When cup formation is performed on automated equipment, such as is supplied by Horauf & ICE of Farmington, Conn. or Paper Machinery Corporation of Milwaukee, Wis., it may be advantageous to make the width of the adhered portions along the seam-forming sides 48*a*, 48*b* of the paperboard blank 42 considerably narrower than the adhered portions along the upper and lower arcuate sides 49*a*, 49*b* of the paperboard blank 42 to avoid thermal damage to unlaminated portions of the shrink film during seam formation.

Thus, a container employing an inner liner for thermal insulation is disclosed. While embodiments of this invention have been shown and described, it will be apparent to those skilled in the art that many more modifications are possible without departing from the inventive concepts herein. The invention, therefore, is not to be restricted except in the spirit of the following claims.

What is claimed is:

1. A container comprising:

a sidewall comprising paperboard including one or more vent(s);

a shrink film inner liner having an intermediate portion peripherally affixed to the sidewall at upper and lower circumferential bands, the vent(s) being disposed within a periphery of the intermediate portion wherein the intermediate portion is adapted to separate from the sidewall with an extent of shrinkage from about 0.125 inches to about 0.50 inches such that ambient air flows through the vent(s) to form an air pocket between the sidewall and the intermediate portion wherein the form, number, and location of the vent(s) are so located such that the shrinkage of the shrink film is not unduly hindered by slow pressure equalization between ambient air and the forming air pocket.

2. The container of claim 1, wherein the vent(s) are disposed near a brim of the sidewall.

3. The container of claim 1, wherein the vent(s) comprises a flap in the sidewall.

4. The container of claim 1, wherein an inner surface of the sidewall is coated with a plastic material.

5. The container of claim 4, wherein the plastic material comprises a polyethylene plastic material.

6. The container of claim 1, wherein the inner liner is formed of a biaxially oriented heat shrinkable plastic material.

7. A container comprising:

a sidewall comprising paperboard including at least one vent;

a shrink film inner liner affixed to the sidewall along upper and lower circumferential bands of the inner liner, the at least one vent being disposed between the upper and lower circumferential bands, wherein an intermediate portion of the inner liner between the upper and lower circumferential bands is adapted to separate from the sidewall wherein the sidewall is provided with at least one vent selected from U-shaped flaps, linear slits, or X-shaped cut-outs such that the intermediate portion is adapted to separate from the sidewall with an extent of shrinkage of from about 0.125 inches to about 0.50 inches such that ambient air flows through the vent(s) to form an air pocket between the sidewall and the intermediate portion ambient air flows through the at least one vent to form an air pocket between the sidewall and the intermediate portion of the inner liner.

8. The container of claim 7, wherein the at least one vent is disposed near a brim of the sidewall.

9. The container of claim 7, wherein the at least one vent comprises a flap in the sidewall.

10. The container of claim 7, wherein the inner liner comprises a heat shrinkable plastic material.

11. The container of claim 7, wherein an inner surface of the sidewall is coated with a plastic material.

12. The container of claim 11, wherein the plastic material comprises a polyethylene plastic material.

13. The container of claim 7, wherein the inner liner is formed of a biaxially oriented heat shrinkable plastic material.

14. A container comprising:

a sidewall comprising paperboard;

a shrink film inner liner affixed to the sidewall along upper and lower circumferential bands of the inner liner, wherein an intermediate portion of the inner liner between the upper and lower circumferential bands is adapted to separate from the sidewall with an extent of shrinkage of from about 0.125 inches to about 0.50 inches such that an air pocket is formed between the sidewall and the intermediate portion of the inner liner, wherein the sidewall is provided with a plurality of vents selected from U-shaped flaps, linear slits, or X-shaped cut-outs wherein the form, number, and location of the vents are so located such that the shrinkage of the shrink film is not unduly hindered by slow pressure equalization between ambient air and the forming air pocket thereby providing for equalization of the pressure in the air pocket with atmospheric pressure.

15. The container of claim 14, comprising at least one vent disposed near a brim of the sidewall.

16. The container of claim 15, wherein the at least one vent comprises a flap in the sidewall.

17. The container of claim 14, wherein the inner liner comprises a heat shrinkable plastic material.

18. The container of claim 14, wherein the inner liner is formed of a biaxially oriented heat shrinkable plastic material.

19. A container comprising:

a tapered sidewall comprising paperboard including a plurality of vents and having an inner surface coated with a plastic material;

a shrink film inner liner, formed of a heat shrinkable plastic material, affixed to the sidewall along upper and lower circumferential bands of the inner liner, wherein an intermediate portion of the inner liner between the upper and lower circumferential bands is adapted to separate from the sidewall with an extent of shrinkage of from about 0.125 inches to about 0.50 inches such that ambient air flows through the vents to form an air pocket between the sidewall and the intermediate portion of the inner liner, the vents being disposed between the upper and lower circumferential bands near a brim of the sidewall, wherein the form, number, and location of the vents are so located such that the shrinkage of a shrink film is not unduly hindered by slow pressure equalization between ambient air and the forming air pocket.

20. The container of claim 19, wherein each vent comprises a flap in the sidewall.

21. The container of claim 19, wherein the plastic material comprises a polyethylene plastic material.

22. The container of claim 19, wherein the inner liner is formed of a biaxially oriented heat shrinkable plastic material.

* * * * *